United States Patent [19]

Tiritilli

[11] 4,168,589

[45] Sep. 25, 1979

[54] EXTRACTOR SAFETY BUSHING FOR HAND GUNS

[76] Inventor: Leonard A. Tiritilli, 631 E. Norman Ave., Arcadia, Calif. 91006

[21] Appl. No.: 874,680

[22] Filed: Feb. 3, 1978

[51] Int. Cl.[2] ..... F41C 15/00

[52] U.S. Cl. ..... 42/68

[58] Field of Search ..... 42/68, 62

[56] References Cited

U.S. PATENT DOCUMENTS

| | | | |
|---|---|---|---|
| 517,152 | 3/1894 | Wesson | 42/68 |
| 702,735 | 6/1902 | Kolb et al. | 42/68 |
| 1,181,417 | 5/1916 | Wesson | 42/68 |
| 3,874,104 | 4/1975 | Sibley | 42/68 |

*Primary Examiner*—Charles T. Jordan

*Attorney, Agent, or Firm*—Christie, Parker & Hale

[57] ABSTRACT

A hand gun has a cylinder, a chamber in the cylinder for holding a shell casing, an extractor rod extending through the cylinder adjacent the chamber, an extractor on an end of the extractor rod normally held in a closed position adjacent the chamber, and a return spring around the extractor rod for normally biasing the extractor into its closed position. The extractor normally can slide the casing entirely out of the chamber in response to travel of the extractor rod. A safety bushing is secured around a portion of the extractor rod, and the return spring is biased against the safety bushing. The safety bushing reduces the travel of the extractor rod which, in turn, limits the distance that the extractor can move the shell casing out of the chamber. The length of the safety bushing is sufficient to prevent the extractor from sliding the casing entirely out of the chamber, but sufficient to still allow the casing to be easily removed from the chamber, so that a casing cannot be jammed in the chamber by the extractor under the bias of the return spring after the extractor rod has been actuated.

14 Claims, 5 Drawing Figures

EXTRACTOR SAFETY BUSHING FOR HAND GUNS

BACKGROUND

This invention relates to a safety bushing for preventing an empty shell casing from being jammed in a chamber of a hand gun by an extractor rod for removing the casing from the chamber.

A revolver commonly used by law enforcement officers includes an extractor rod for emptying spent shell casings from the chambers in the gun cylinder. The extractor rod includes an extractor having fingers which project into respective chambers of the gun cylinder. The tip of each finger fits under a rim on a corresponding shell casing, and the officer empties the chambers by depressing the extractor rod which causes the extractor to slide the shell casings out of the chambers.

In a service revolver manufactured by Smith and Wesson, the extractor slides the spent shell casings entirely out of the chamber when the extractor rod is actuated. This type of revolver is commonly used by most law enforcement officers in this country. To empty the shell casings from the chambers, the officer inverts the gun and depresses the extractor rod and waits for the casings to fall clear of the weapon before releasing the extractor rod.

When a shell casing is withdrawn entirely from the chamber, the extractor is free to pass over the end of the rim on a shell case; and if the officer releases the extractor rod too quickly, without waiting long enough for the cases to clear the weapon, the extractor can push the case back into the chamber and can jam the case in the chamber. The extractor is then not in a position to withdraw the case from the chamber, and the officer will not be able to reload until the case is removed from the chamber. This requires a tedious and time-consuming task of picking the case out of the chamber, say by removing the case by hand or by inserting a probe into the opposite end of the chamber and pushing the case out of the chamber.

If an officer is in a stress situation, such as being under fire, the officer can easily allow the extractor rod to return too quickly and therefore jam a spent casing in the chamber. The officer then can be defenseless until he can remove the jammed casing and reload. Several actual cases have occurred in which an officer jammed a shell casing in his service revolver while under fire.

The present invention provides means for limiting the stroke length of an ejector rod in a revolver of the type used by law enforcement officers. By limiting the stroke of the ejector rod, the shell casing is not entirely withdrawn from the chamber when the extractor rod is pushed its full stroke length, although the extractor rod can travel through a stroke length long enough to allow the shell casings to easily fall from the chambers. In this way the extractor cannot slip over the end of a casing and jam the casing in a chamber during the return stroke of the extractor rod.

SUMMARY OF THE INVENTION

This invention provides a safety bushing which can be installed on the extractor rod of a revolver commonly used by law enforcement officers. The safety bushing reduces the stroke length of the extractor rod. The revolver includes an extractor rod extending through a cylinder of the gun for extracting a shell casing from a chamber in the cylinder. The extractor rod includes an elongated extractor carrier aligned longitudinally with an elongated ejector member, an extractor on an end of the extractor carrier opposite the ejector member, and a return spring around the extractor carrier for normally biasing the extractor into a closed position adjacent the chamber. The ejector member projects from an opposite side of the chamber. The ejector can be pushed against the bias of the return spring for causing the extractor to move away from the chamber and slide the casing out of the chamber. The safety bushing is releasably secured between the ejector member and the extractor carrier, and the return spring is biased against the safety bushing. The safety bushing is of sufficient length to limit the travel of the extractor away from the chamber so as to prevent the casing from being withdrawn entirely from the chamber. The safety bushing can be releasably secured to the extractor rod, say by retrofitting procedures, so that the stroke length of the extractor rod in existing service revolvers can be limited.

These and other aspects of the invention will be more fully understood by referring to the following detailed description and the accompanying drawings.

DRAWINGS

DETAILED DESCRIPTION

Figure 1:
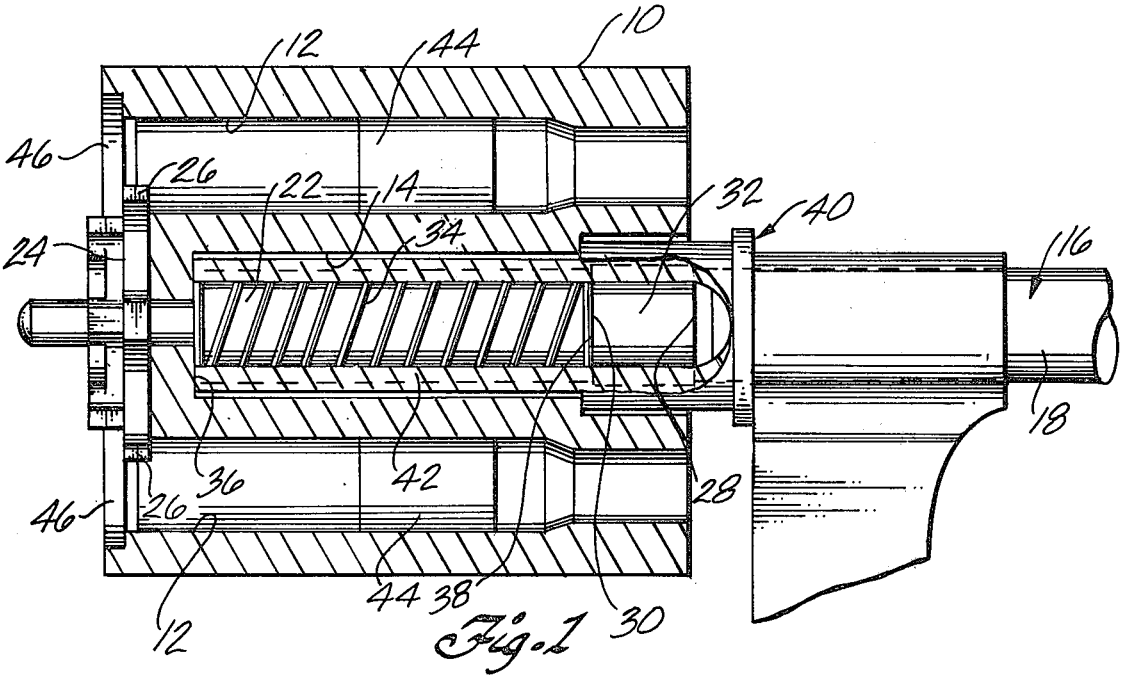
FIG. 1 is a fragmentary, cross-sectional elevation view showing a cylinder of a hand gun having an extractor rod assembly in which an extractor is held in a closed position.

FIG. 1 shows a cylinder 10 of a hand gun such as a Smith and Wesson K-frame or N-frame revolver for .38 or .357 magnum calibers of the type commonly used by law enforcement officers. The cylinder includes chambers 12 circumferentially spaced apart around the axis of an internal bore 14 concentric with the cylinder.

An extractor rod assembly 16 extends concentrically through the bore 14 in the cylinder 10. The extractor rod assembly includes an elongated ejector member 18 having a free end 20 located outside one end of the cylinder. The extractor rod also includes an elongated extractor carrier 22 extending collinear with respect to the ejector member 18. The extractor carrier 22 has an outside end which carries an extractor 24 located adjacent an end of the cylinder opposite the end 20 of the ejector 18. The extractor 24 has projecting fingers 26, each of which extends into a corresponding chamber 12 of the gun cylinder. An inner face 28 of the ejector member 18 is spaced from an inner face 30 of the extractor carrier 22, and a safety bushing 32 is releasably secured between the faces 28, 30 of the ejector 18 and the extractor carrier 22, respectively.

A return spring 34, in the form of a coil spring, extends around a portion of the extractor carrier 22 which travels in the bore 14. The return spring 34 has one end which bears against an internal face 36 in an end of the bore 14 adjacent the extractor 24. An opposite end of the return spring is urged against an annular face 38 of the safety bushing 32.

An ejector rod safety collar 40 includes a sleeve 42 located in the bore 14 of the cylinder. The sleeve 42 surrounds portions of the ejector member 18, the safety bushing 32, the extractor carrier 22, and the return spring 34 which travel in the cylinder. The sleeve guides travel of the extractor rod assembly back and forth in the cylinder.

FIG. 1 shows a normal or closed position of the extractor rod assembly prior to ejecting spent shell casings 44 from respective chambers 12 of the cylinder. Each finger 26 of the extractor 24 fits under a corresponding rim 46 projecting from an end of a corresponding casing 44. The return spring 34 normally biases the extractor 24 into the closed position shown in FIG. 1 so that the cases 44 are held in the chambers until the extractor rod assembly is actuated.

Figure 2:
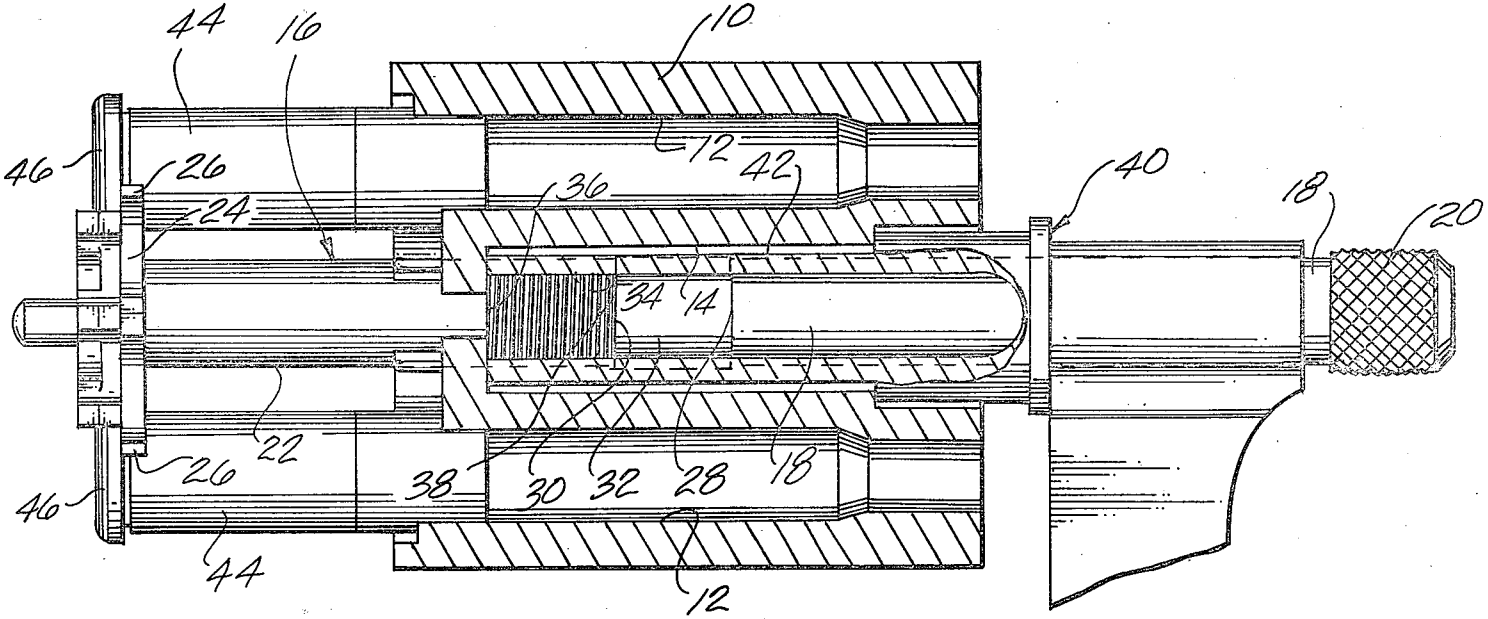
FIG. 2 is a fragmentary, cross-sectional elevation view similar to FIG. 1 showing the extractor in an open position.

FIG. 2 shows the extractor rod assembly 16 in its actuated or open position in which the extractor rod is moved longitudinally relative to the cylinder, say by pushing on the free end 20 of the ejector 18. This slides the extractor 24 away from the end of the cylinder 10 so that each finger 26 pushes against the rim 46 of a corresponding shell casing 44 to slide the casing out of its corresponding chamber 12.

The hand gun shown in the drawings is normally manufactured and sold to law enforcement officers without the safety bushing 32. In this instance the ejector member 18 and the extractor carrier 22 are secured adjacent one another on the extractor rod. It is common to include a narrow flange (not shown) between the adjacent faces 28, 30 of the ejector and the extractor carrier 18, 22, respectively. The return spring is normally biased against the face of the narrow flange so that the working end of the return spring is very close to the face 28 of the ejector 18. In this instance, when the extractor rod is actuated to empty the casings from the chambers, the extractor rod travels through a relatively long stroke length to withdraw the casing from the chamber so that the inner end of the casing 44 can clear the outer end of its respective chamber. Such a long stroke length is produced because the face 28 of the ejector member 18 can travel a longer distance through the cylinder than is possible in the embodiment shown in FIG. 2 in which the safety bushing 32 is present between the ejector member 18 and the extractor carrier 22. The safety bushing 32 acts as a spacer to lengthen the distance between the face 28 of the ejector member 18 and the adjacent end of the return spring 34. Thus, when the extractor rod is moved to its open position shown in FIG. 2, the stroke length of the ejector rod is shortened when compared with a firearm not having the safety bushing 32.

The length of the safety bushing 32 is sufficient so as to limit the stroke length of the extractor rod so that the extractor 24 does not completely remove the casings 44 from the chambers 12. The safety bushing 32 shortens the effective stroke length of the extractor rod by about 25% of its normal travel without the safety bushing. This allows each case 44 to be withdrawn sufficiently far from the chamber that the case can fall under gravity to clear the weapon when the extractor rod travels its full stroke length. Thus, the fingers 26 of the extractor can not extend over the rim 46 of a case and cause the case to be jammed in the chamber when the extractor rod is returned to its normal position under the bias of the return spring 34.

The safety bushing 32 preferably has a length in the range of 0.26 to 0.29 inch. The length of the safety bushing is illustrated by the dimension a in FIG. 4. This length reduces the travel of the extractor 24 from the end of the chamber by about 0.23 to 0.26 inch when compared with the normal configuration (in absence of the safety bushing) in which the end of the return spring 34 is about 0.03 inch from the face 28 of the ejector member 18. I have found that this stroke length is sufficient to prevent jamming of a casing in the chamber and yet withdrawing each shell case sufficiently far from the chambers that the cases can be emptied with a relatively quick depression and release of the extractor rod.

Figure 5:
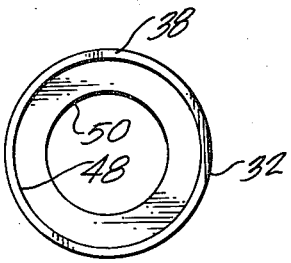
FIG. 5 is an end elevation view taken on line 5—5 of FIG. 4.
Figure 4:
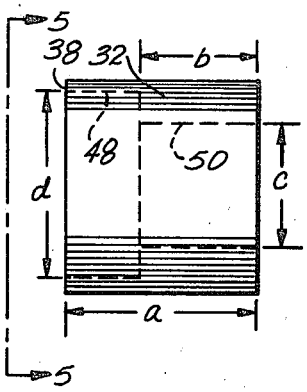
FIG. 4 is an elevation view showing the safety bushing.

Referring to FIGS. 4 and 5, the safety bushing is shaped as a tubular open-ended cylinder which includes a stepped bore extending concentrically through the bushing. The stepped bore includes a relatively wider circular bore 48 which is stepped down to form a narrower circular bore 50. The wider bore 48 is formed adjacent the face 38 of the bushing against which the return spring 34 is biased. The narrower bore is longer than the wider bore, the length of the narrower bore being preferably 0.180 inch and being depicted by the dimension b in FIG. 4. The inside diameter of the smaller bore 50 is preferably 0.187 inch and is shown as dimension c in FIG. 4, and the inside diameter of the wider bore 48 is preferably 0.260 inch and is shown as dimension d in FIG. 4.

Figure 3:
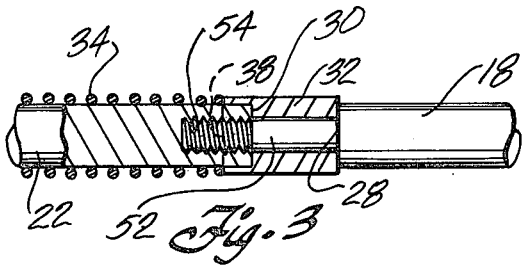
FIG. 3 is a fragmentary elevation view, partly in cross-section, showing a safety bushing secured to a portion of an extractor rod.

The safety bushing 32 is secured to the extractor rod assembly by fitting the end of the extractor carrier 22 into the wider bore 48 of the bushing 32, as shown in FIG. 3. The ejector member 18 has an externally threaded projecting portion 52 which extends through the narrower bore 50 of the safety bushing 32. The threaded projecting portion 52 also extends into a corresponding internally threaded bore 54 in the cooperating end of the extractor carrier 22. A rod which normally extends through the extractor carrier 22 and the ejector member 18, together with a plunger for the rod, are not shown in FIG. 3 for simplicity.

The safety bushing 32 provides an effective means for retrofitting existing firearms to prevent the extractor from travelling so far that it completely withdraws the shell casings from the chambers.

I claim:

1. An extractor rod for hand guns comprising:

an extractor rod extending through a cylinder of a hand gun for extracting a shell casing from a chamber in the cylinder, the extractor rod having an elongated extractor carrier adjacent the chamber and an elongated ejector aligned longitudinally with the extractor carrier and extending outside the chamber;

an extractor on an end of the extractor carrier for ejecting a shell casing from the chamber in response to movement of the extractor rod;

a return spring disposed around the extractor carrier; and a safety bushing releasably secured between the extractor carrier and the ejector, the return spring being urged against the safety bushing and toward the ejector for normally biasing the extractor into a closed position adjacent the chamber, the extractor rod being movable against the bias of the return spring for moving the extractor away from the chamber to slide a casing out of the chamber, the safety bushing being of sufficient length to limit travel of the extractor away from the chamber so as to prevent the casing from being withdrawn entirely from the chamber, whereas the extractor could be removed a farther distance away from the chamber to withdraw the casing entirely from the chamber in the absence of the safety bushing.

2. Apparatus according to claim 1 wherein the safety bushing has a length in the range of about 0.26 to about 0.29 inch.

3. Apparatus according to claim 1 in which the ejector has a face toward which the return spring is normally biased, and in which the safety bushing is releasably secured between the extractor carrier and the face of the ejector; and the safety bushing has a shoulder parallel to the face of the ejector and the return spring is normally biased against the shoulder of the safety bushing.

4. Apparatus according to claim 3 in which the face of the ejector is disposed against a face of the safety bushing opposite the shoulder of the safety bushing.

5. Apparatus according to claim 3 in which the safety bushing has an internal bore and the extractor carrier is releasably disposed in the bore.

6. Apparatus according to claim 5 in which an internal projection on the ejector extends through the safety bushing and is releasably secured to an internal portion of the extractor carrier.

7. Apparatus according to claim 1 in which the extractor extends away from the chamber by a distance in the range of about 0.23 to about 0.26 inch.

8. In a hand gun having an extractor rod extending through a cylinder for extracting a shell casing from a chamber in the cylinder, in which the extractor rod has an elongated extractor carrier aligned longitudinally with an elongated ejector, an extractor on an end of the extractor carrier opposite the ejector, and a return spring disposed around the extractor carrier for normally biasing the extractor into a closed position adjacent the chamber, with the ejector projecting from an opposite side of the chamber, and in which the projecting portion of the ejector can be pushed against the bias of the return spring for causing the extractor to move away from the chamber and slide the casing entirely out of the chamber, the improvement comprising:

an elongated safety bushing having means for being secured between the ejector and the extractor carrier, the bushing having means for receiving the bias of the return spring, the safety bushing being of sufficient length to limit travel of the extractor away from the chamber so as to prevent the casing from being removed entirely from the chamber.

9. The improvement according to claim 8 in which the safety bushing has a length in the range of about 0.26 to about 0.29 inch.

10. The improvement according to claim 8 in which the ejector has a face toward which the return spring is normally urged, and in which the safety bushing can be releasably secured between the extractor carrier and the face of the ejector; and the safety bushing has a shoulder parallel to the face of the ejector against which the return spring is biased.

11. The improvement according to claim 10 in which the safety bushing has a face opposite the shoulder for being disposed against the face of the ejector.

12. The improvement according to claim 10 in which the safety bushing has an internal bore for releasably receiving a portion of the extractor carrier.

13. The improvement according to claim 12 in which the ejector has an internal projection for being releasably secured to an internal portion of the extractor carrier; and in which the internal projection extends through a cooperating internal portion of the safety bushing.

14. The improvement according to claim 8 in which the safety bushing is of sufficient length to limit travel of the extractor away from the chamber by a distance in the range of about 0.23 to about 0.26 inch.

* * * * *